US007099823B2

(12) United States Patent
Takamizawa

(10) Patent No.: US 7,099,823 B2
(45) Date of Patent: Aug. 29, 2006

(54) CODED VOICE SIGNAL FORMAT CONVERTING APPARATUS

(75) Inventor: Yuichiro Takamizawa, Tokyo (JP)

(73) Assignee: NEC Corporation, Tokyo (JP)

( * ) Notice: Subject to any disclaimer, the term of this patent is extended or adjusted under 35 U.S.C. 154(b) by 868 days.

(21) Appl. No.: 09/793,463

(22) Filed: Feb. 27, 2001

(65) Prior Publication Data

US 2001/0018651 A1 Aug. 30, 2001

(30) Foreign Application Priority Data

Feb. 28, 2000 (JP) ..... 2000-052037

(51) Int. Cl.
*G10L 19/00* (2006.01)
*G10L 11/06* (2006.01)

(52) U.S. Cl. ..... 704/230; 704/208

(58) Field of Classification Search ..... 704/200.1, 704/229, 233, 208, 269, 500, 230; 382/233, 382/251; 370/316
See application file for complete search history.

(56) References Cited

U.S. PATENT DOCUMENTS

| | | | | |
|---|---|---|---|---|
| 5,530,750 A | | 6/1996 | Akagiri | |
| 5,541,852 A | * | 7/1996 | Eyuboglu et al. | 709/232 |
| 5,754,127 A | * | 5/1998 | Tsutsui et al. | 341/54 |
| 5,848,391 A | * | 12/1998 | Bosi et al. | 704/200.1 |
| 6,134,523 A | * | 10/2000 | Nakajima et al. | 704/229 |
| 6,141,446 A | * | 10/2000 | Boliek et al. | 382/233 |
| 6,415,251 B1 | * | 7/2002 | Oikawa et al. | 704/200.1 |
| 6,456,968 B1 | * | 9/2002 | Taniguchi et al. | 704/229 |
| 6,501,863 B1 | * | 12/2002 | Fukuhara et al. | 382/251 |

FOREIGN PATENT DOCUMENTS

| | | |
|---|---|---|
| GB | 2 321 577 A | 7/1998 |
| JP | 10-178350 | 6/1998 |
| JP | 10-336672 | 12/1998 |
| WO | WO 01/61686 A1 | 8/2001 |

OTHER PUBLICATIONS

"Coding of Moving Pictures and Associated Audio For Digital Storage Media At Up To About 1,5 Mbit/s"; ISO/IEC/11172–3; International Standard; 1993; 3 Sheets.
BOSI et al.; IS 13818–7 MPEG–2 Advanced Audio Coding, AAC; International Organization For Standardization; ISO/IEC JTC1/SC29/WG11; Coding of Moving Pictures and Audio; Apr. 1997; pp. 1–7.
"Digital Audio Compression Standard (AC–3)"; Advanced Television Systems Committee; Dec. 20, 1995; pp. 1–15.
Nakajima et al., "MPEG Audio Bit Rate Scaling on Coded Data Domain," Procedings of the 1998 IEEE International Conference on Acoustics, Speech and Signal Processing, vol. 6, May 12–15, 1998, pp. 3669–3672, XP–000951254.
Fletcher, John, "Optimum Re–Encoding of Decoded Audio Using a MOLE Signal," BBC Research & Development, Kingswood Warren, Tadworth, Surrey, KT20 6NP, United Kingdom, May 1998.

* cited by examiner

*Primary Examiner*—David Hudspeth
*Assistant Examiner*—Jakieda Jackson
(74) *Attorney, Agent, or Firm*—Foley & Lardner LLP

(57) ABSTRACT

A coded voice signal format converting apparatus is provided which is capable of converting a signal format of a coded voice signal by computations in reduced amounts. In the coded voice signal format converting apparatus, in a second coding device is employed a quantizing accuracy information converting section to which a first quantizing accuracy information output from a quantizing accuracy information decoding section in a first decoding device is input. Second mapping signal is quantized by a mapped signal coding section to produce a coded voice signal and the first quantizing accuracy information is converted so that it can be used by mapped signal coding section to determine a second quantizing accuracy information.

13 Claims, 6 Drawing Sheets

CODED VOICE SIGNAL FORMAT CONVERTING APPARATUS

BACKGROUND OF THE INVENTION

1. Field of the Invention

The present invention relates to a coded voice signal format converting apparatus and more particularly to the coded voice signal format converting apparatus to convert a format of a voice signal coded by compression or a like between two different voice coding/decoding systems.

The present application claims priority of Japanese Patent Application No. 2000-052037 filed on Feb. 28, 2000, which is hereby incorporated by reference.

2. Description of the Related Art

As communications technology progresses in recent years, voice signals are generally handled in a coded manner by using a compression method or a like, which requires a coded voice signal format converting apparatus to convert a signal format of voice signals coded by the compression method or the like. When format of the coded voice signal is converted using such a coded voice signal format converting apparatus, it is desired that conversion of signal format can be made by computations in reduced amounts. Moreover, signal format converting technology of this kind is applied not only to voice signals but also to image signals.

One example of a conventional coded signal format converting apparatus adapted to convert, by computations in reduced amounts, a format of an image signal coded by compression method or a like is disclosed in, for example, Japanese Patent Application Laid-open No. Hei10-336672. The conventional coded signal format converting apparatus, as shown in FIG. 6, is made up of a decoding section 51, a motion vector memory 52, a resolution converting section 53 and a coding section 54 having a motion compensating section 55 and a coding processing section 56.

In the configurations described above, a coded moving picture (image signal) made up of an MPEG-2 (Motion Picture Experts Group-2) video input through an input terminal 61 is decoded into its original moving picture by the decoding section 51 and, at the same time, a motion vector existing at a time of coding and being contained in each coded data is stored in the motion vector memory 52. Decoded moving picture is input to the resolution converting section 53 and, after being sized so as to be handled by a method in which the input moving picture is re-coded by the resolution converting section 53, is further input to the coding section 54. In the coding section 54, the moving picture is re-coded based on the motion vector detected by the motion compensating section 55 from the motion vector memory 52 and is then output to outside communication devices or a like through an output terminal 62.

However, the conventional coded signal format converting apparatus disclosed in the above Japanese Patent Application Laid-open No. Hei 10-336672 has a problem in that, since this apparatus is intended for conversion of format of image signals made up of moving pictures, it cannot be applied to voice signals having no information about motion vectors. Therefore, it is not expected that a coded voice signal format converting apparatus capable of converting a format of a voice signal by computations in reduced amounts can be implemented.

In the conventional coded voice signal format converting apparatus, generally, a decoding device is connected, in serial, to a coding device. For example, when a format of a coded voice signal compressed by a coding device operating in accordance with a first coding/decoding system (voice coding/decoding system) is converted into a format which can be decoded by a decoding device operating in accordance with a second coding/decoding system (voice coding/decoding system), first, a coded voice signal whose format has not been converted is decoded by the decoding device operating in accordance with the first coding/decoding system and a voice signal is obtained. Then, the obtained voice signal is coded by using the coding device operating in accordance with the second coding/decoding system and a coded voice signal that can be decoded by the decoding device operating in accordance with the second coding/decoding system is obtained. As the decoding device and the coding device making up the conventional coded voice signal format converting device, existing available decoding and coding devices may be used in general.

The above first coding/decoding system is adapted to operate in accordance with, for example, any one of MPEG Audio, MPEG-2AAC and Dolby AC-3 systems. The above second coding/decoding system is also adapted to operate in accordance with any one of MPEG Audio, MPEG-2AAC and Dolby AC-3 systems, however, though both the first and second coding/decoding methods are operated in accordance with any one of these three systems, configurations of the first coding/decoding system are different from those of the second coding/decoding system.

The MPEG Audio system is described in detail in, for example, "ISO/IEC/11172-3, Coding of Moving Pictures and Associated Audio for Digital Storage Media at up to about 1.5 Mb/s" (hereinafter referred to as "Reference 1"). The MPEG-2AAC system is described in detail in, for example, "ISO/IEC/13818-7, Generic Coding of Moving Pictures and Associated Audio Information, 1993" (hereinafter referred to as "Reference 2"). The Dolby AC-3 system is described in detail in, for example, "Advanced Television Systems Committee A/52, Digital Audio Compression Standard (AC-3), 1995 (hereinafter referred to as "Reference 3").

Next, configurations of a conventional coded voice signal format converting device will be described by referring to FIG. 5. As shown in FIG. 5, in the conventional coded voice signal format converting device, a first decoding device 310 adapted to operate in accordance with a first coding/decoding system is connected, in serial, to a second coding device 320 adapted to operate in accordance with a second coding/decoding system. A voice signal which has been coded in advance with the first coding/decoding system, after being decoded by the first decoding device 310, is coded by the second coding device 320 that can be decoded by a decoding device adapted to operate in accordance with the second coding/decoding method.

The first decoding device 310 includes a mapped signal generating section 311, a inverse mapping converting section 312 and a quantizing accuracy information decoding section 313. Even if any one of the MPEG Audio, MPEG-2AAC and Dolby AC-3 systems is employed by the first decoding device 310, configurations of the first decoding device 310 are common to any one of the three systems. However, configurations of the mapped signal generating section 311, inverse mapping converting section 312 and quantizing accuracy information decoding section 313 vary depending on each of the three systems and details of these three systems are provided in the above Reference 1 to Reference 3.

The second coding device 320 includes a mapping converting section 321, a mapped signal coding section 322 and a quantizing accuracy calculating section 323. Similarly, even if any one of the MPEG Audio, MPEG-2AAC and Dolby AC-3 is employed, configurations of the first decoding device 310 are common to any one of the three systems. However, configurations of the mapping converting section 321, mapped signal coding section 322 and quantizing accuracy calculating section 323 vary depending on each of the three systems and details of each of the three systems are provided in the Reference 1 to Reference 3 as described above.

Next, operations of the coded voice signal format converting apparatus will be described by referring to FIG. 5. A coded voice signal input through an input terminal 300 which has been in advance coded in accordance with the first coding/decoding system and whose format has to be converted is input to both the mapped signal generating section 311 and the quantizing accuracy information decoding section 313 in the first decoding device 310. The quantizing accuracy information decoding section 313 obtains, by decoding a part of the input coded voice signal, information about quantizing accuracy indicating how finely each of frequency components of the voice signal has been quantized. The mapped signal generating section 311 first obtains, by decoding a part of the coded voice signal, a quantized value of a mapped signal. Then, the mapped signal generating section 311, by quantizing, in reverse, the obtained quantized value of the mapped signal based on quantizing accuracy designated by the quantizing accuracy information output from the quantizing accuracy information decoding section 313, obtains a first mapped signal.

The inverse mapping converting section 312, by making inverse mapping conversions of the first mapped signal output from the mapped signal generating section 311, obtains a first voice signal. The inverse mapping conversion is equivalent to a sub-band synthetic filter processing described in the Reference 1 and to inverse modified discrete cosine transform processing described in the Reference 2 and Reference 3.

The first voice signal output from the inverse mapping converting section 312 in the first decoding device 310 is input to the mapping converting section 321 and quantizing accuracy calculating section 323 in the second coding device 320. The mapping converting section 321, by making mapping conversions of the input voice signal, obtains a second mapped signal. The mapping conversion is equivalent to a sub-band analysis filter processing described in the Reference 1 and to a modified discrete cosine transform processing described in the Reference 2 and Reference 3. The mapped signal indicates a frequency component of the input voice signal.

The quantizing accuracy calculating section 323 analyzes the input voice signal and determines how finely the mapped signal indicating each of the frequency component of the voice signal is quantized. That is, more finer quantizing is performed on the frequency component that can be easily perceived by a human ear and less fine quantizing is performed on the frequency component that cannot be easily perceived by the human ear. Whether the frequency component can be easily perceived by the human ear or not is determined by an analysis on the input voice signal using a method in which a perception model of the human ear is imitated. The analysis method is described in detail in the Reference 1 Reference and 2 and its explanation is omitted accordingly. The method in which the perception model of the human ear is imitated is called a "psychological auditory sense analysis", however, processing of the method is very complicated and, in general, the method requires very large amounts of computational processes.

The mapped signal coding section 322 quantizes the mapped signal output from the mapping converting section 321 based on quantizing accuracy calculated by the quantizing accuracy calculating section 323 to obtain a quantized value. Then, the quantizing accuracy calculating section 323 converts the obtained quantized value into coded strings to obtain a coded voice signal. The coded voice signal whose format has been thus converted is output from an output terminal 301.

However, the above conventional coded voice signal format converting apparatus has a problem in that it includes configuration elements requiring large amounts of computational processes, thus making it difficult to perform the voice signal format conversion by computations in reduced amounts. That is, in the conventional coded voice signal format converting apparatus, as shown in FIG. 5, the first decoding device 310 adapted to operate in the first coding/decoding system is connected, in series, to the second coding device 320 adapted to operate in accordance with the second coding/decoding system, however, since the second coding device 320 includes the quantizing accuracy calculating section 323 which requires large amounts of computational processes.

The quantizing accuracy calculating section 323 determines, based on the psychological auditory sense analysis described above, the quantizing accuracy defining how finely the mapped signal indicating each of frequency components of the input voice signal is quantized. However, its processing is very complicated and requires large amounts of computational processes, thus causing amounts of computational processes required for the conversion of voice signal formats to be made large.

SUMMARY OF THE INVENTION

In view of the above, it is an object of the present invention to provide a coded voice signal format converting apparatus capable of converting a signal format of a coded voice signal by computations in reduced amounts.

According to a first aspect of the present invention, there is provide a coded voice signal format converting apparatus for converting a format of a coded voice signal between two different voice coding/decoding systems.

A first decoding device is used to decode the coded voice signal whose format has not been converted and to produce a first voice signal in accordance with a first voice coding/decoding system.

A second coding device is used to code the first voice signal and to produce a coded voice signal whose format has been converted in accordance with a second voice coding/decoding system.

The first decoding device includes a quantizing accuracy information decoding section to decode a first quantizing accuracy information coded into the coded voice signal whose format has not been converted and a mapped signal generating section to decode and inverse-quantize, a quantized value coded into the coded voice signal whose format has not been converted in accordance with the first quantizing accuracy information and to produce a first mapped signal. The second coding device includes a quantizing accuracy information converting section to determine a second quantizing accuracy information and a mapped signal coding section to quantize and code a voice signal output from the first decoding device based on the second quantizing accuracy information and to produce a coded voice signal whose format has been converted.

According to a second aspect of the present invention, there is provided a coded voice signal format converting apparatus for converting a format of a coded voice signal between two different voice coding/decoding systems.

A first decoding device is used to decode the coded voice signal whose format has not been converted and to produce a first voice signal in accordance with a first voice coding/decoding system;

A second coding device is used to code the first voice signal and to produce a coded voice signal whose format has been converted in accordance with a second voice coding/decoding system.

The first decoding device includes a quantizing accuracy information decoding section to decode a first quantizing accuracy information coded into a coded voice signal whose format has not been converted, a mapped signal generating section to decode and quantize, in reverse, a quantized value coded into the coded voice signal whose format has not been converted in accordance with the first quantizing accuracy information and to produce a first mapped signal and a inverse mapping converting section to make inverse mapping conversions of the first mapped signal and to produce the first voice signal. The second coding device includes a mapping converting section to make mapping conversions of the first voice signal and to produce a second mapped signal, a quantizing accuracy information converting section to determine second quantizing accuracy information and a mapped signal coding section to quantize and code the second mapped signal based on the second quantizing accuracy information and to produce the coded voice signal whose format has been converted and wherein the quantizing accuracy decoding section outputs the first quantizing accuracy information to the quantizing accuracy information converting section and, in the quantizing accuracy information converting section, the second quantizing accuracy information is determined by converting the first quantizing accuracy information so that the first quantizing accuracy information becomes at least one of a time section or frequency resolution required for obtaining the second quantizing accuracy information.

According to a third aspect of the present invention, there is provided a coded voice signal format converting apparatus for converting a format of a coded voice signal between two different voice coding/decoding systems.

A first decoding device is used to decode the coded voice signal whose format has not been converted and to produce a first voice signal in accordance with a first voice coding/decoding system.

A second coding device is used to code the first voice signal and to produce a coded voice signal whose format has been converted in accordance with a second voice coding/decoding system.

The two different voice coding/decoding systems use a same mapping converting method and a same inverse mapping converting method.

The first decoding device includes a quantizing accuracy information decoding section to decode first quantizing accuracy information coded into the coded voice signal whose format has not been converted and a mapped signal generating section to decode and inverse-quantize, a quantized value coded into the coded voice signal whose format has not been converted in accordance with the first quantizing accuracy information and to produce a first mapped signal.

The second coding device includes a quantizing accuracy information converting section to determine the quantizing accuracy information and a mapped signal coding section to quantize and code the first mapped signal based on the second quantizing accuracy information and to produce the coded voice signal whose format has been converted.

The quantizing accuracy decoding section outputs the first quantizing accuracy information to the quantizing accuracy information converting section and, in the quantizing accuracy information converting section, the second quantizing accuracy information is determined by converting the first quantizing accuracy information so that the first quantizing accuracy information becomes at least one of a time section or frequency resolution required for obtaining the second quantizing accuracy information.

In the foregoing, a preferable mode is one wherein, in the quantizing accuracy converting section, quantizing accuracy information obtained in a first time section and in a first frequency band provides quantizing accuracy information at a maximum level out of quantizing accuracy information extracted from the first quantizing accuracy information obtained in overlapping time sections and frequency bands in the first time section and in the first frequency band.

Also, a preferable mode is one wherein the inverse mapping converting section makes inverse mapping conversions by using sub-band synthetic filter processing or inverse modified discrete cosine transforming processing.

Also, a preferable mode is one wherein the mapping converting section makes mapping conversions by using sub-band analysis filter processing or modified discrete cosine transforming processing.

Also, a preferable mode is one wherein the first voice coding/decoding system is configured by any one of MPEG (Motion Picture Experts Group) Audio, MPEG-2AAC and Dolby AC-3 systems.

Furthermore, a preferable mode is one wherein configurations of the second voice coding/decoding system are different from those of the first voice coding/decoding system and the second voice coding/decoding system is configured by any one of MPEG Audio, MPEG-2AAC and Dolby AC-3 systems.

With the configurations above, by connecting, in series, the decoding device to the coding device, by employing the quantizing accuracy information converting section in the coding device, by inputting, to the quantizing accuracy information converting section, the first quantizing accuracy information output from the quantizing accuracy information decoding section in the decoding device, by quantizing the mapped signal using the mapped signal coding section in the second coding device to obtain the quantized value and to produce the coded voice signal and by converting the format of the first quantizing accuracy information so that the qunatizing accuracy information can be used by the mapped signal coding section to determine the second quantizing accuracy information, it is made possible to acquire the second quantinzing accuracy information by computations in reduced amounts.

With another configuration as above, by using the same mapping converting method and inverse mapping converting method for the voice coding/decoding system in the decoding device and coding device to remove the inverse mapping converting processing and mapping converting processing, amounts of computational processes required for the conversion can be further reduced. Thus, the conversion of formats of coded voice signals by computations in reduced amounts can be achieved.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
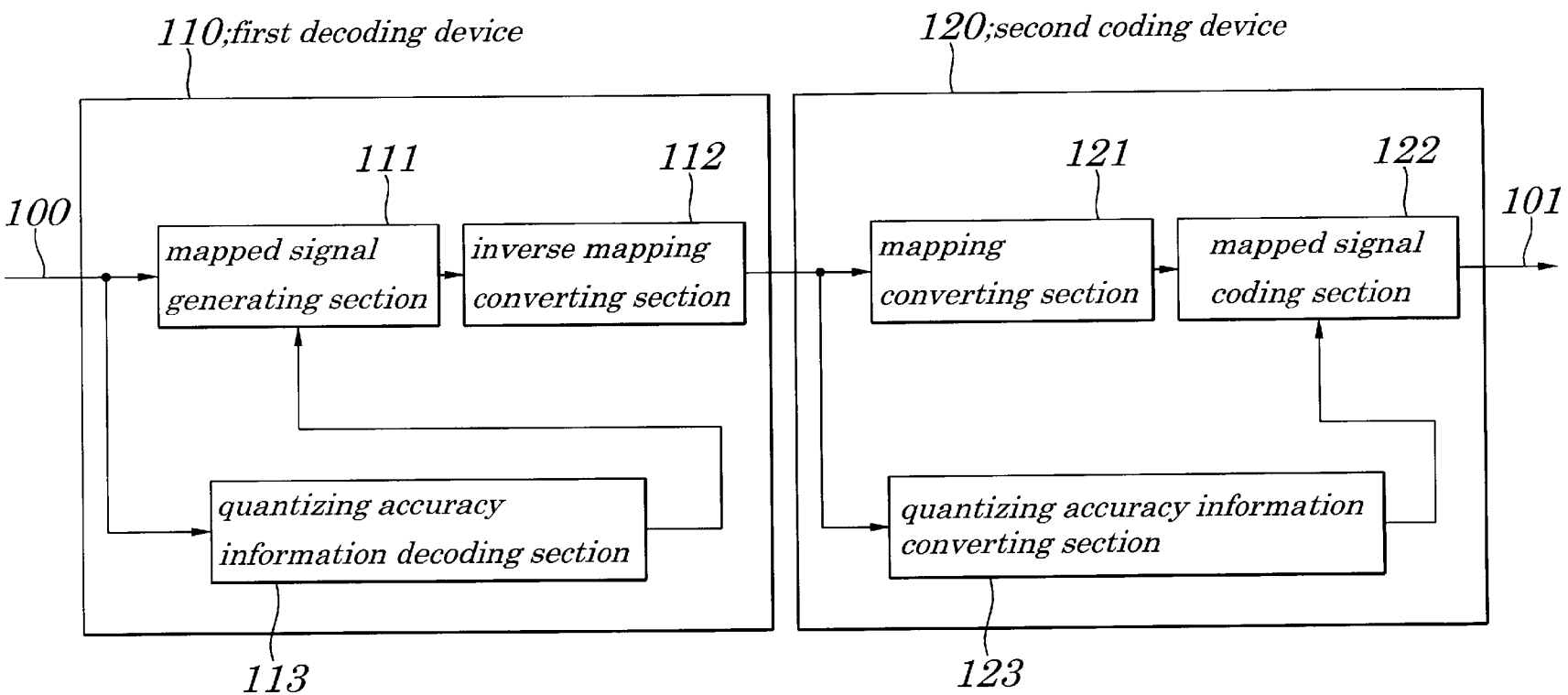
FIG. 1 is a schematic block diagram showing configurations of a coded voice signal format converting apparatus according to a first embodiment of the present invention.
Figure 2:
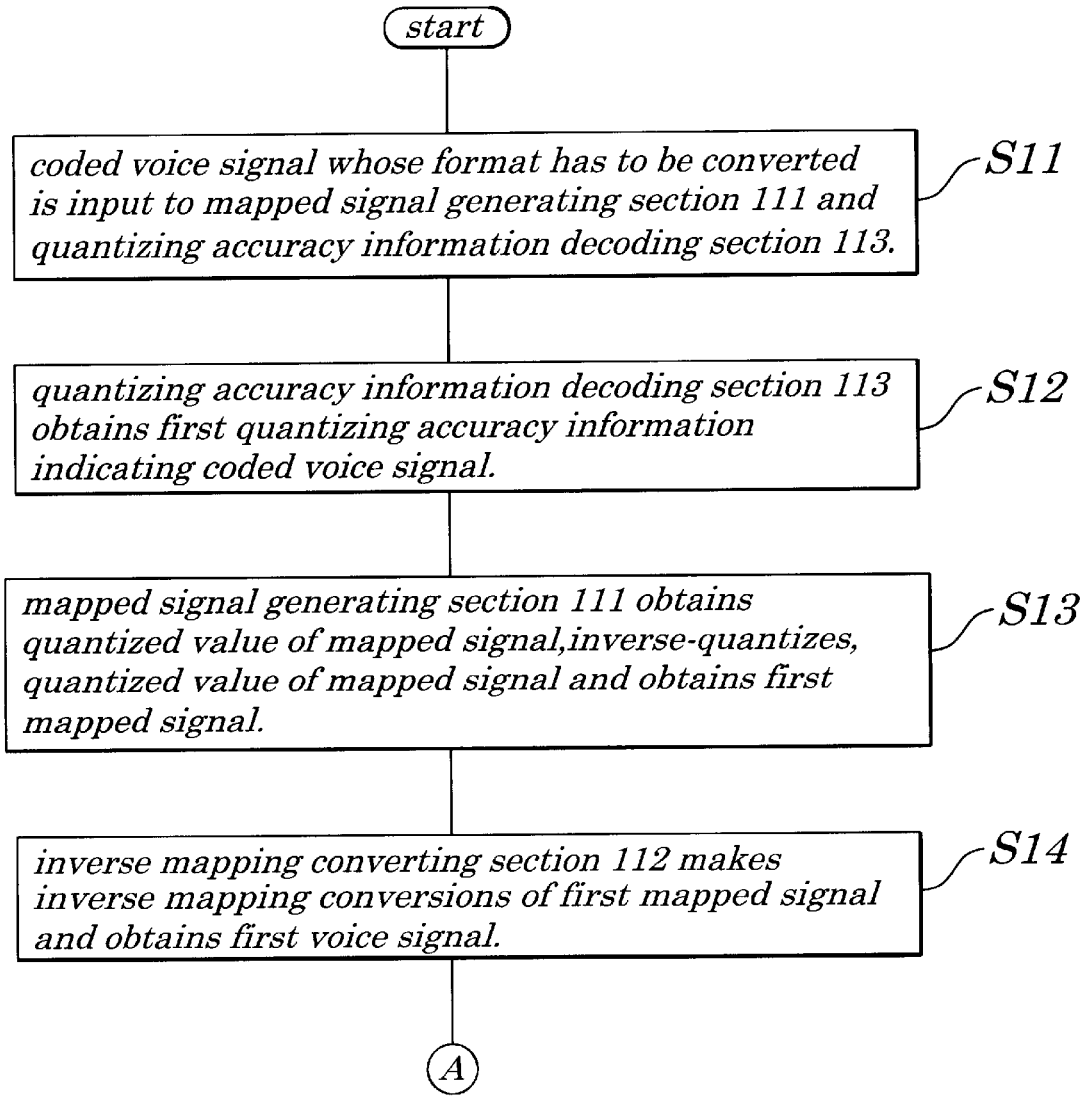
FIG. 2 is a flowchart explaining operations of the coded voice signal format converting apparatus according to the first embodiment of the present invention.
Figure 3:
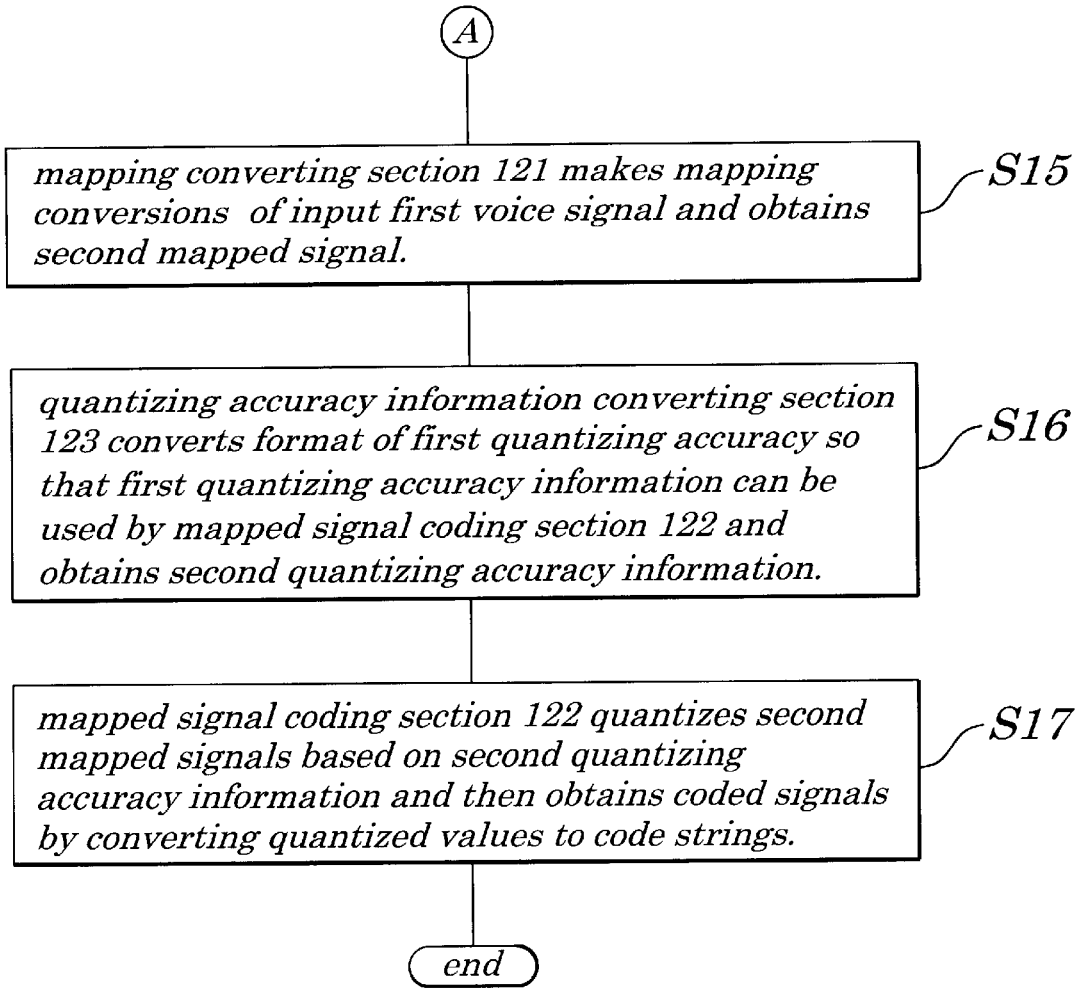
FIG. 3 is also a flowchart explaining operations of the coded voice signal format converting apparatus according to the first embodiment of the present invention.

FIG. 1 is a schematic block diagram showing configurations of a coded voice signal format converting apparatus according to a first embodiment of the present invention. FIGS. 2 and 3 are flowcharts explaining operations of the coded voice signal format converting apparatus of the first embodiment. As shown in FIG. 1, in the coded voice signal format converting apparatus of the first embodiment, a first decoding device 110 adapted to operate in accordance with a first coding/decoding system is connected, in series, to a second coding device 120 adapted to operate in accordance with a second coding/decoding system. A voice signal which has been in advance coded in accordance with the first coding/decoding system, after being decoded by the first decoding device 110, is coded by the second coding device 120 and becomes a coded voice signal that can be decoded by a decoding device adapted to operate in accordance with the second coding/decoding system.

The first decoding device 110 includes a mapped signal generating section 111, a inverse mapping converting section 112 and a quantizing accuracy information decoding section 113. Even if any one of the MPEG Audio, MPEG-2AAC and Dolby AC-3 systems is employed, configurations of the first decoding device 110 are common to any one of the three systems. However, configurations of the mapped signal generating section 111, inverse mapping converting section 112 and quantizing accuracy information decoding section 113 vary depending on each of the three systems and details of each of these three systems are provided in the above Reference 1 to Reference 3.

The second coding device 120 includes a mapping converting section 121, a mapped signal coding section 122 and a quantizing accuracy information converting section 123. To the quantizing accuracy information converting calculating section 123 is input first quantizing accuracy information from the quantizing accuracy information decoding section 113. In the embodiment, instead of quantizing accuracy calculating section 323 used in the conventional example is employed the quantizing accuracy information converting section 123 to which an output of the quantizing accuracy information decoding section 113 in the first decoding device 110 is input. Even if any one of the MPEG Audio, MPEG-2AAC and Dolby AC-3 systems is employed, configurations of the second coding device 120, as in the case of the first decoding device 110, are common to any one of the three systems. However, configurations of the mapped signal converting section 121, mapping coding section 122 and quantizing accuracy information converting section 123 vary depending on each of the three systems and details of each of these three systems are provided in the above Reference 1 to Reference 3.

Next, operations of the coded voice signal format converting apparatus will be described by referring to FIG. 2 and FIG. 3. The coded voice signal input from an input terminal 100 which has been in advance coded in accordance with the first coding/decoding system and whose format has to be converted is input to both the mapped signal generating section 111 and the quantizing accuracy information decoding section 113 in the first decoding device 110 (Step S11). The quantizing accuracy information decoding section 113, by decoding a part of the coded voice signal, obtains the first quantizing accuracy information indicating how finely each of frequency components of the coded voice signal is quantized (Step S12). The obtained first quantizing accuracy information is output to the mapped signal generating section 111 in the first decoding device 110 and to the quantizing accuracy information converting section 123 in the second coding device 120.

The mapped signal generating section 111 decodes a part of the coded voice signal and obtains a quantized value of the mapped signal. The mapped signal generating section 111 inverse quantizes, the quantized value of the obtained mapped signal based on the quantizing accuracy designated by the first quantizing accuracy information output from the quantizing accuracy information decoding section 113 and obtains a first mapped signal (Step S13). The inverse mapping converting section 112 makes inverse mapping conversions of the first mapped signal output by the mapped signal generating section 111 and obtains a first voice signal (Step 314). The inverse mapping conversion is equivalent to the sub-band synthetic filter processing described in the Reference 1 and to the inverse modified discrete cosine transform processing described in the Reference 2 and Reference 3.

The first voice signal output from the inverse mapping converting section 112 in the first decoding device 110 is input to the mapping converting section 121 in the second coding device 120. The mapping converting section 121 makes mapping conversions of the input first voice signal and obtains a second mapped signal (Step S15). The inverse mapping conversion is equivalent to the sub-band analysis filter processing described in the Reference 1 and to the inverse modified discrete cosine transform processing described in the Reference 2 and Reference 3. The mapped signal indicates the frequency component of the input voice signal.

The quantizing accuracy information converting section 123 converts the format of the first quantizing accuracy information output from the quantizing accuracy information decoding section 113 in the first decoding section 110 so that the information can be used by the mapped signal coding section 122 in the second coding device 120 and determines second quantizing accuracy information (Step S16). The method for conversion of the format will be described later. The second quantizing accuracy information obtained by the conversion of the format is output to the mapped signal coding section 122. The mapped signal coding section 122 first quantizes the second mapped signal output from the mapping converting section 121 based on the quantizing accuracy designated by the second quantizing accuracy information output from the quantizing accuracy information converting section 123 and obtains a quantized value. Next, the obtained quantized value is converted to code strings to obtain the coded voice signal (Step S17). The coded voice signal whose format has been thus converted is output to an output terminal 101.

Operations of the quantizing accuracy information converting section 123 will be further described in detail. The quantizing accuracy information converting section 123, as described above, converts frequency resolution or a time section, or both of them so that the first quantizing accuracy information output from the quantizing accuracy information decoding section 113 in the first decoding device 110 can be used by the mapped signal coding section 122 in the second coding device 120.

First, the conversion of the frequency resolution will be described. For example, let it be assumed that the quantizing accuracy information decoding section 113 in the first decoding device 110 outputs quantizing accuracy in each of bands obtained by splitting a spectrum of a voice signal into "512" and the mapped signal coding section 122 in the second coding device 120 requires quantizing accuracy to be obtained in "1024" bands. Thus, if the number of bands in which the quantizing accuracy is obtained differs between the quantizing accuracy information decoding section 113 and the mapped signal coding section 122, it is necessary to make conversions of the frequency resolution.

In the example, the quantizing accuracy in an n-th ("n" is a natural number) split band to be output by the quantizing accuracy information converting section 123 is obtained by performing a computation of quantizing accuracy output from the quantizing accuracy information decoding section 113 and obtained in one or more split bands in which there is an overlap of frequency, even if it is a slight one, between the band used for the quantizing accuracy information converting section 123 and the band used for the quantizing accuracy information decoding section 113. To perform the computation, for example, a computation method by which the maximum quantizing accuracy becomes its computational result or an averaging computation method may be utilized.

Next, the conversion of the time section will be described. In the case, the quantizing accuracy is calculated based on an analysis in each of time sections obtained by splitting a voice signal in a manner that each time section has a different time length for every coding/decoding system. If the time section to be analyzed that is required by the second coding device 120 for calculating the quantizing accuracy does not coincide with the time section that has been used for calculating the quantizing accuracy output by the first decoding device 110, it is necessary to convert the time section.

The quantizing accuracy in an n-th split band and in a time section to be output by the quantizing accuracy information converting section 123 is obtained by performing a computation of quantizing accuracy output from the quantizing accuracy information decoding section 113 and obtained in the n-th split band and in one or more time sections during which there is an overlap, even if it is a slight one, between the time section used for the quantizing accuracy information converting section 123 and the time section used for the quantizing accuracy information decoding section 113. To perform the computation, for example, the computation method by which maximum quantizing accuracy becomes its computational result or an averaging computation method may be utilized.

Moreover, in some cases, conversions of both frequency resolution and time section are required. In such case, the quantizing accuracy in an n-th split band and in a time section to be output by the quantizing accuracy information converting section 123 is obtained by performing a computation of quantizing accuracy output from the quantizing accuracy information decoding section 113 and obtained in the n-th split band and in one or more time sections in and during which there is an overlap of the frequency resolution, even if it is a slight one, between the time section and split band used for the quantizing accuracy information converting section 123 and the time section and split band used for the qunatizing accuracy information decoding section 113. To perform the computation, for example, the computation method by which the maximum quantizing accuracy becomes its computational result or the averaging computation method may be utilized.

Thus, according to the first embodiment, instead of the quantizing accuracy calculating section 323 employed in the conventional apparatus, the quantizing accuracy information converting section 123 is used in the second coding device 120 making up the coded voice signal format converting apparatus and to the quantizing accuracy information converting section 123 is input the first quantizing accuracy information output from the quantizing accuracy information decoding section 113 in the first decoding device 110 which is quantized by the mapped signal coding section 122 in the second coding device 120 to obtain the quantized value and to produce the coded voice signal. Since the format of the first quantizing accuracy information is converted so that the information can be used by the mapped signal coding section 122 in the second coding device 120 to determine the second quantizing accuracy, it is made possible to obtain the second quantizing accuracy information by computations in less amounts, compared with those in the conventional case. This is because, the quantizing accuracy information converting section 123 of the first embodiment is achieved, by using not the conventional psychological auditory sense analysis causing very complicated procedures, but the ordinarily known simple computation method.

Thus, the conversion of formats of coded voice signals by computations in reduced amounts can be achieved.

Second Embodiment

Figure 4:
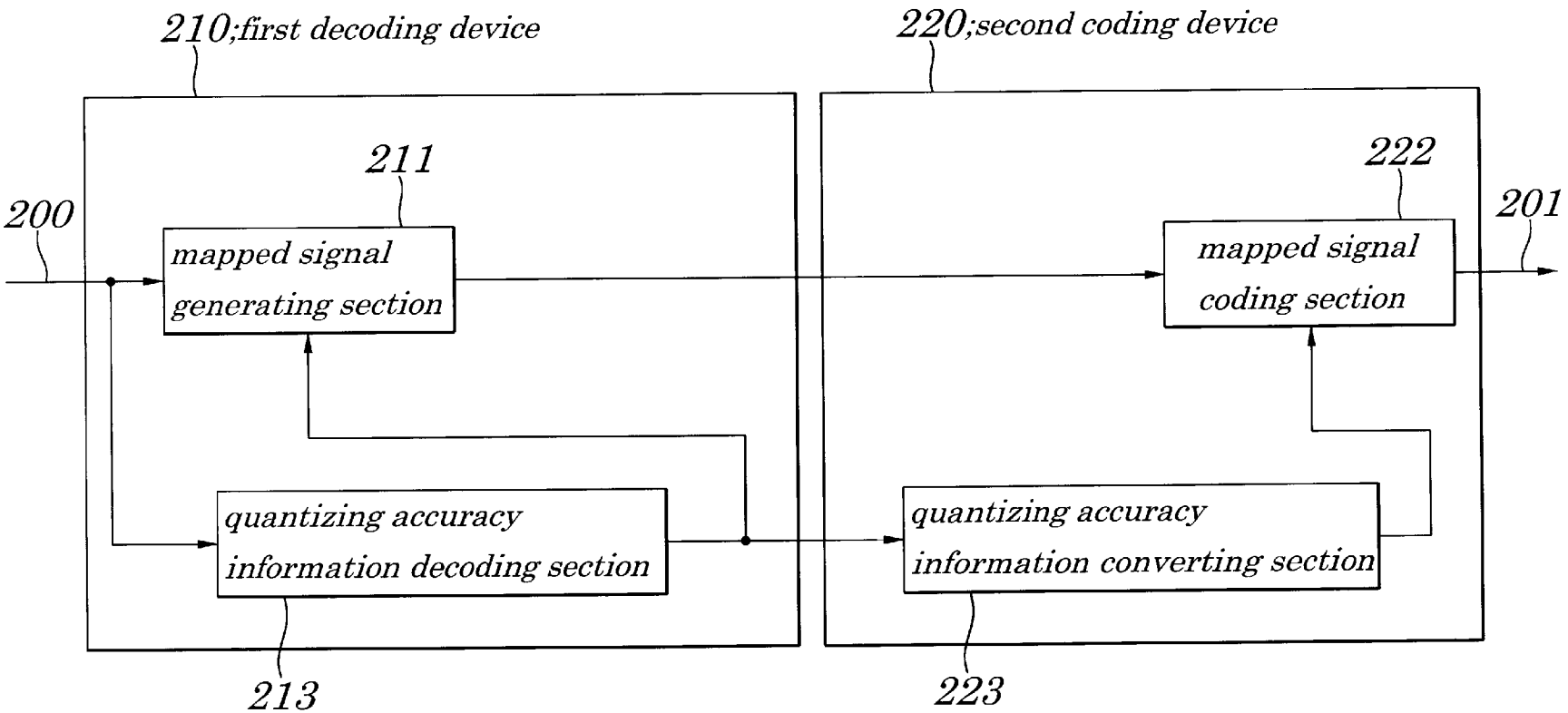
FIG. 4 is a schematic block diagram showing configurations of a coded voice signal format converting apparatus according to a second embodiment of the present invention.
Figure 5:
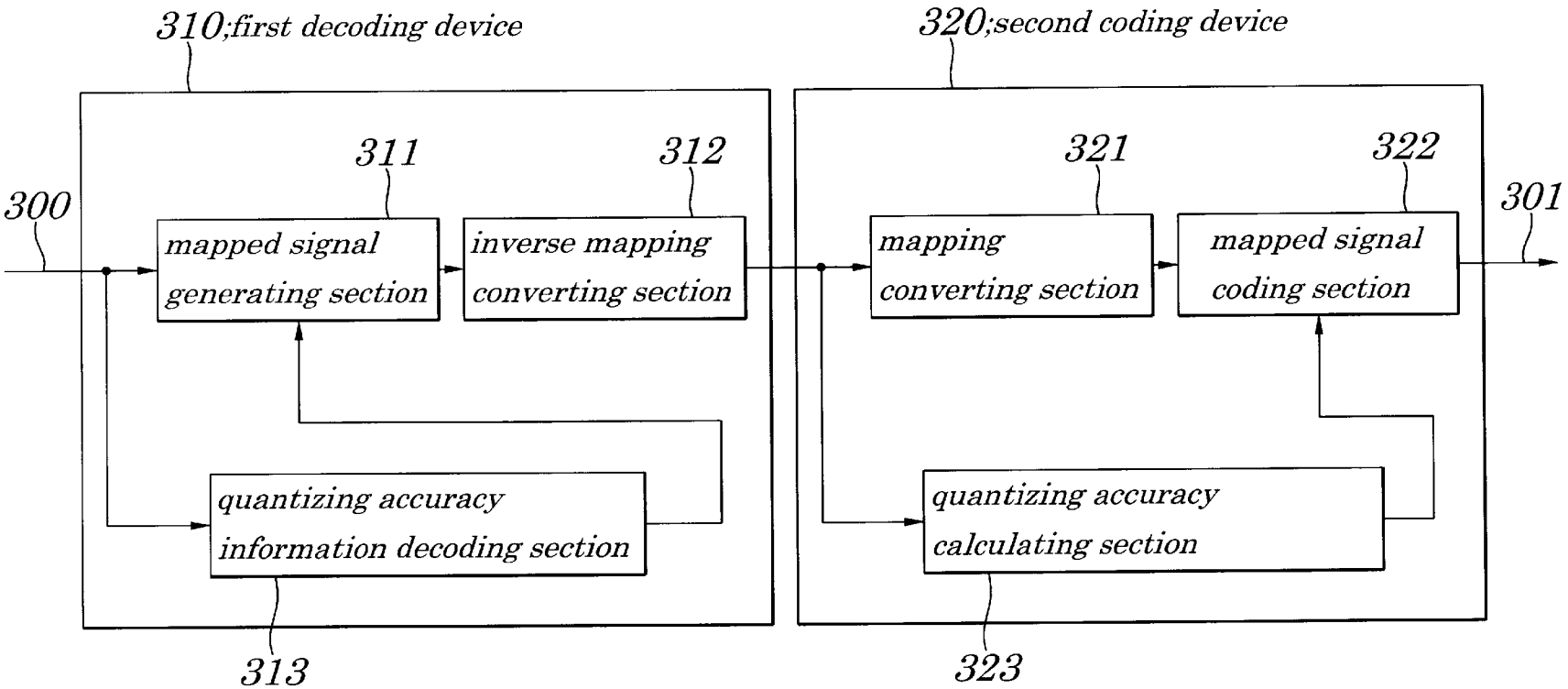
FIG.5 (PRIOR ART)
FIG. 5 is a schematic block diagram showing configurations of a conventional coded voice signal format converting apparatus.
Figure 6:
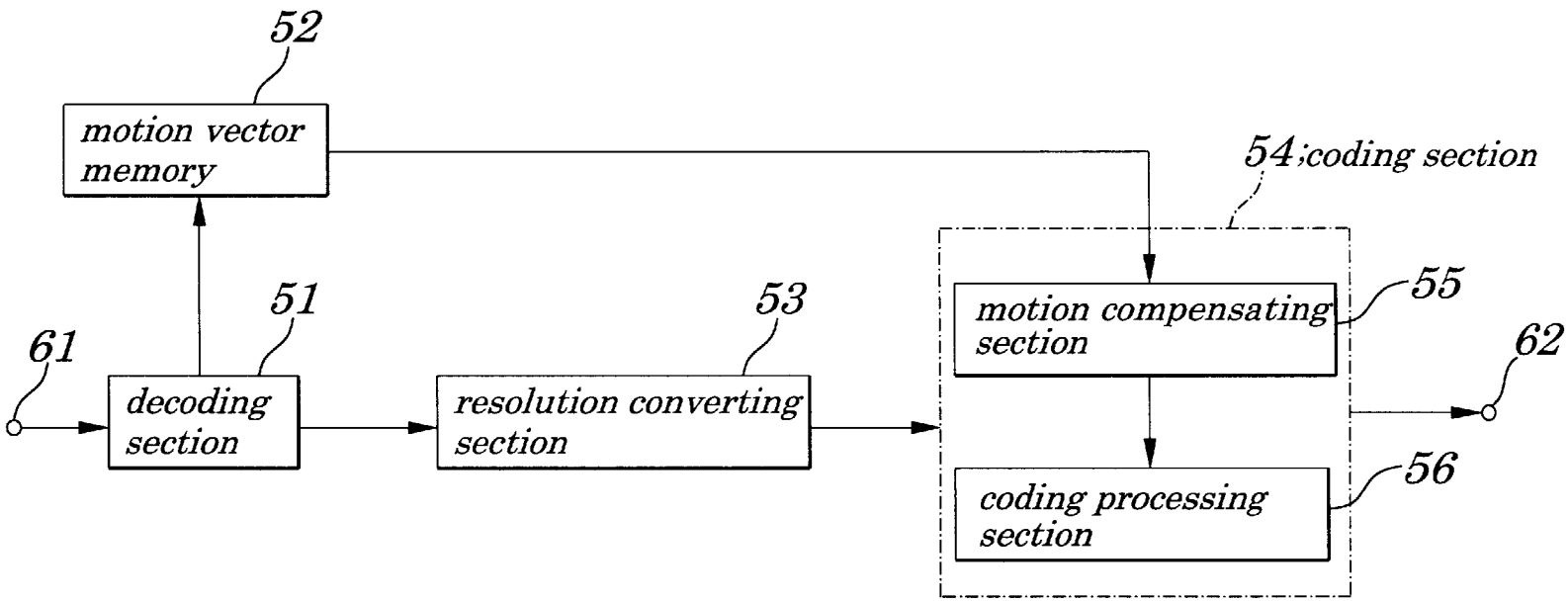
FIG.6 (PRIOR ART)
FIG. 6 is a schematic block diagram showing configurations of another conventional coded voice signal format converting apparatus.

FIG. 4 is a schematic block diagram showing configurations of a coded voice signal format converting apparatus according to a second embodiment of the present invention. The coded voice signal format converting apparatus of the second embodiment differs greatly from that of the first embodiment in that a inverse mapping converting section 112 in a first decoding device 110 employed in the first embodiment and a mapping converting section 121 in a second coding device 120 employed in the first embodiment are removed. In a first decoding device 210 and second coding device 220 in the coded voice signal format converting apparatus of the second embodiment, when a voice coding/decoding system uses a same mapping converting method and a same inverse mapping converting method, that is, when the voice coding/decoding systems to be used before conversion of a format of a coded voice signal and to be used after the conversion of the format of the coded voice signal use the same mapping method and inverse mapping converting method, the inverse mapping converting section 112 in the first decoding device 110 and the mapping converting section 121 in the second coding device 120 employed in the first embodiment can be removed.

As shown in FIG. 4, the coded voice signal format converting apparatus of the second embodiment includes the first decoding device 210 and the second coding device 220, both of which are adapted to operate in accordance with a same voice coding/decoding system. That is, the first decoding device 210 includes only a mapped signal generating section 211 and quantizing accuracy information decoding section 213, but does not have the inverse mapping converting section 112. Moreover, the second coding device 220 includes only a mapped signal coding section 222 and quantizing accuracy information converting section 223, but does not have the mapping converting section 121. A coded voice signal whose format has not been converted is input through an input terminal 200 and the coded voice signal whose format has been converted is output from an output terminal 201.

The same voice coding/decoding system is configured by any one of an MPEG Audio Layer1, MPEG Audio Layer2, and MPEG Audio Layer3. In any case, the same mapping converting method and inverse mapping converting method are employed.

As described above, by configuring the first decoding device 210 and second coding device 220 in accordance with the same voice coding/decoding system, an output signal of the mapped signal generating section 211 becomes equivalent to an input signal of the mapped signal coding section 222, thus eliminating a need of the inverse mapping converting section 112 and mapping converting section 121. This enables a further reduction of amounts of computational processes. Moreover, operations of the coded voice signal format converting section of the second embodiment are substantially the same as those in the first embodiment and their descriptions are omitted accordingly.

Thus, according to the second embodiment, almost the same effects as obtained in the first embodiment can be implemented. Additionally, according to the second embodiment, since the mounting of the inverse mapping converting section 112 and mapping converting section 121 is omitted, it is made possible not only to simplify configurations of the coded voice signal format converting apparatus but also to reduce further amounts of computational processes required for conversion.

It is apparent that the present invention is not limited to the above embodiments but may be changed and modified without departing from the scope and spirit of the invention. For example, in the above embodiments, the first coding/decoding system (voice coding/decoding system) and the second coding/decoding system (voice coding/decoding system) are configured by MPEG Audio, MPEG-2AAC, or Dolby AC-3 systems, however, only if substantially the same configurations as the first decoding device 110 and second coding device 120 as shown in the first embodiment are provided, the first and second coding/decoding system may be configured by other systems.

What is claimed is:

1. A coded voice signal format converting apparatus for converting a format of a coded voice signal between two different voice coding/decoding systems comprising:

a first decoding device used to decode said coded voice signal whose format has not been converted and to produce a first voice signal in accordance with a first voice coding/decoding system;

a second coding device used to code said first voice signal and to produce a coded voice signal whose format has been converted in accordance with a second voice coding/decoding system; and wherein said first decoding device includes:

a quantizing accuracy information decoding section to decode a first quantizing accuracy information coded into said coded voice signal whose format has not been converted and generating a first quantized accuracy information signal, a mapped signal generating section to decode and inverse-quantize, a quantized value coded into said coded voice signal whose format has not been converted in accordance with said first quantizing accuracy information and to produce a first mapped signal and wherein said second coding device includes:

a quantizing accuracy information converting section receiving said first quantized accuracy information signal from said quantizing accuracy information decoding section of said first decoding device, and in response thereto determining a second quantizing accuracy information and a mapped signal coding section to quantize and code a voice signal output from said first decoding device based on said second quantizing accuracy information and to produce a coded voice signal whose format has been converted.

2. The coded voice signal format converting apparatus according to claim 1, wherein said first voice coding/decoding system is configured by any one of an MPEG (Motion Picture Experts Group) Audio, MPEG-2AAC and Dolby AC-3 systems.

3. The coded voice signal format converting apparatus according to claim 1, wherein configurations of said second voice coding/decoding system are different from those of said first voice coding/decoding system and said second voice coding/decoding system is configured by any one of said MPEG Audio, MPEG-2AAC, and Dolby AC-3 system.

4. A coded voice signal format converting apparatus for converting a format of a coded voice signal between two different voice coding/decoding systems comprising:

a first decoding device used to decode said coded voice signal whose format has not been converted and to produce a first voice signal in accordance with a first voice coding/decoding system;

a second coding device used to code said first voice signal and to produce a coded voice signal whose format has been converted in accordance with a second voice coding/decoding system; and wherein said first decoding device includes:

a quantizing accuracy information decoding section to decode a first quantizing accuracy information coded into said coded voice signal whose format has not been converted, a mapped signal generating section to decode and inverse-quantize, a quantized value coded into said coded voice signal whose format has not been converted in accordance with said first quantizing accuracy information and to produce a first mapped signal and an inverse mapping converting section to make inverse mapping conversions of said first mapped signal and to produce said first voice signal and wherein said second coding device includes:

a mapping converting section to make mapping conversions of said first voice signal and to produce a second mapped signal, a quantizing accuracy information converting section to determine second quantizing accuracy information and a mapped signal coding section to quantize and code said second mapped signal based on said second quantizing accuracy information and to produce said coded voice signal whose format has been converted and wherein said quantizing accuracy information decoding section of said first decoding device outputs said first quantizing accuracy information to said quantizing accuracy information converting section of said second device and, in said quantizing accuracy information converting section of said second coding device, said second quantizing accuracy information is determined by converting said first quantizing accuracy information received from said quantizing accuracy information decoding section of said first decoding device so that said first quantizing accuracy information becomes at least one of a time section or frequency resolution required for obtaining said second quantizing accuracy information.

5. The coded voice signal format converting apparatus according to claim 4, wherein, in said quantizing accuracy converting section, quantizing accuracy information obtained in a first time section and in a first frequency band provides quantizing accuracy information at a maximum level out of said quantizing accuracy information extracted from said first quantizing accuracy information obtained in overlapping time sections and frequency bands in said first time section and in said first frequency band.

6. The coded voice signal format converting apparatus according to claim 4, wherein said inverse mapping converting section makes inverse mapping conversions by using sub-band synthetic filter processing or inverse modified discrete cosine transforming processing.

7. The coded voice signal format converting apparatus according to claims 4, wherein said mapping converting section makes mapping conversions by using sub-band analysis filter processing or modified discrete cosine transforming processing.

8. The coded voice signal format converting apparatus according to claim 4, wherein said first voice coding/decoding system is configured by any one of an MPEG (Motion Picture Experts Group) Audio, MPEG-2AAC and Dolby AC-3 systems.

9. The coded voice signal format converting apparatus according to claim 4, wherein configurations of said second voice coding/decoding system are different from those of said first voice coding/decoding system and said second voice coding/decoding system is configured by any one of said MPEG Audio, MPEG-2AAC, and Dolby AC-3 system.

10. A coded voice signal format converting apparatus for converting a format of a coded voice signal between two different voice coding/decoding systems comprising:

a first decoding device used to decode said coded voice signal whose format has not been converted and to produce a first voice signal in accordance with a first voice coding/decoding system;

a second coding device used to code said first voice signal and to produce a coded voice signal whose format has been converted in accordance with a second voice coding/decoding system; and wherein, when said two different voice coding/decoding systems use a same mapping converting method and a same inverse mapping converting method, said first decoding device includes:

a quantizing accuracy information decoding section to decode first quantizing accuracy information coded into said coded voice signal whose format has not been converted, and a mapped signal generating section to decode and inverse-quantize, a quantized value coded into said coded voice signal whose format has not been converted in accordance with said first quantizing accuracy information and to produce a first mapped signal, and wherein said second coding device includes:

a quantizing accuracy information converting section to determine said quantizing accuracy information; and a mapped signal coding section to quantize and code said first mapped signal based on said second quantizing accuracy information and to produce said coded voice signal whose format has been converted, and wherein said quantizing accuracy information decoding section outputs said first quantizing accuracy information to said quantizing accuracy information converting section and, in said quantizing accuracy information converting section, said second quantizing accuracy information is determined by converting said first quantizing accuracy information so that said first quantizing accuracy information becomes at least one of a time section or frequency resolution required for obtaining said second quantizing accuracy information.

11. The coded voice signal format converting apparatus according to claim 10, wherein, in said quantizing accuracy converting section, quantizing accuracy information obtained in a first time section and in a first frequency band provides quantizing accuracy information at a maximum level out of said quantizing accuracy information extracted from said first quantizing accuracy information obtained in overlapping time sections and frequency bands in said first time section and in said first frequency band.

12. The coded voice signal format converting apparatus according to claim 10, wherein said first voice coding/decoding system is configured by any one of an MPEG (Motion Picture Experts Group) Audio, MPEG-2AAC and Dolby AC-3 systems.

13. The coded voice signal format converting apparatus according to claim 10, wherein configurations of said second voice coding/decoding system are different from those of said first voice coding/decoding system and said second voice coding!decoding system is configured by any one of said MPEG Audio, MPEG-2AAC, and Dolby AC-3 system.

* * * * *